US005819335A

United States Patent [19]

Hennessy

[11] Patent Number: 5,819,335

[45] Date of Patent: Oct. 13, 1998

[54] WASHING FACILITY

[76] Inventor: Frank J. Hennessy, 100 Arboleda La., Carmel Valley, Calif. 93924

[21] Appl. No.: 680,562

[22] Filed: Jul. 12, 1996

Related U.S. Application Data

[63] Continuation-in-part of Ser. No. 612,370, Mar. 7, 1996, which is a continuation-in-part of Ser. No. 511,141, Aug. 4, 1995, abandoned, which is a continuation-in-part of Ser. No. 222,455, Apr. 4, 1994, abandoned.

[51] Int. Cl.[6] ..... A47K 1/04

[52] U.S. Cl. ..... 4/619; 4/584; 4/631; 4/651; 4/678; 4/682; 4/694

[58] Field of Search ..... 4/507, 559, 584, 4/619, 631, 650, 651, 653, 675, 676, 678, 680, 682, 683, 687, 694, 572.1, 541.1; 251/229; D23/233, 238, 241, 242, 245, 250, 252, 284, 291, 293, 293.1

[56] References Cited

U.S. PATENT DOCUMENTS

| | | | |
|---|---|---|---|
| D. 358,870 | 5/1995 | Formgren | D23/250 |
| 563,064 | 6/1896 | Putnam | 4/651 |
| 832,320 | 10/1906 | James | 4/584 |
| 1,406,030 | 2/1922 | Kelly . | |
| 1,424,251 | 8/1922 | Kelly . | |
| 1,666,583 | 4/1928 | Rost | 4/682 |
| 1,676,035 | 7/1928 | Lehnert . | |
| 1,784,641 | 12/1930 | Oldfield . | |
| 1,788,216 | 1/1931 | Watrous . | |
| 1,821,584 | 9/1931 | Schultis . | |
| 1,930,633 | 10/1933 | Waltrous | 4/194 |
| 1,947,250 | 2/1934 | Davison et al. | 4/584 |
| 2,017,416 | 10/1935 | Mallet et al. | 4/199 |
| 2,052,565 | 9/1936 | Groeniger | 4/199 |
| 2,062,809 | 12/1936 | Erickson | 4/187 |
| 2,105,944 | 1/1938 | Graf | 113/51 |
| 2,139,671 | 12/1938 | Corbin, Jr. | 4/195 |
| 2,171,133 | 8/1939 | Stanton | 4/196 |
| 2,243,204 | 5/1941 | Groeniger | 4/199 |
| 2,362,950 | 11/1944 | Vieyra | 4/584 |
| 2,564,190 | 8/1951 | Danielson | 4/173 |
| 2,575,636 | 11/1951 | Patch | 4/173 |
| 2,705,329 | 4/1955 | Exton-Porter | 4/173 |
| 2,767,407 | 10/1956 | Weiss | 4/166 |
| 3,156,931 | 11/1964 | Holtman | 4/166 |
| 3,496,741 | 2/1970 | Arlt, Jr. | 4/653 |
| 3,505,693 | 4/1970 | Corbett | 4/584 |
| 3,577,572 | 5/1971 | Ruggles et al. | 4/187 |
| 3,895,401 | 7/1975 | Walraven | 4/198 |
| 4,158,243 | 6/1979 | McCann | 4/653 |
| 4,765,002 | 8/1988 | Platner | 4/619 |
| 4,777,676 | 10/1988 | Ericson | 4/619 |
| 4,881,280 | 11/1989 | Lesikar | 4/507 |
| 4,886,210 | 12/1989 | Gaffney et al. | 4/678 |
| 4,937,899 | 7/1990 | Morris et al. | 4/651 |
| 4,991,241 | 2/1991 | Bergmann et al. | 4/619 |
| 5,388,285 | 2/1995 | Belniak | 4/507 |

FOREIGN PATENT DOCUMENTS

| | | | |
|---|---|---|---|
| 2629115 | 9/1989 | France | 4/675 |
| 1956161 | 6/1970 | Germany | 4/676 |
| 2855010 | 6/1980 | Germany | 4/675 |

*Primary Examiner*—Charles R. Eloshway
*Attorney, Agent, or Firm*—Leo F. Costello

[57] ABSTRACT

A washing facility including a receptacle fabricated in sheet material with deck portions. The preferred receptacle has vertical front and rear planar walls joined by an arcuate central wall. The rear wall has an inlet, and the front wall has an overflow and an outlet, the former being visible but the latter being obscured from the front of the facility. A water supply unit on the exterior of the receptacle under the deck includes a nozzle over the inlet, for ejecting water from the inlet in an arcing laminar sheet, and valves connected to the nozzle. Valve control handles are slidably mounted on the deck and connected to the valves through the deck. A water drainage unit on the exterior of the receptacle has a chamber over the overflow and the outlet, stopper slidable between open and closed position, and a drain conduit leading from the chamber. A stopper handle located on the inner surface of the receptacle is attached to the stopper for moving the stopper between its two positions. The installed facility eliminates the undesirable projection of conventional spouts and handles into the washing area.

17 Claims, 7 Drawing Sheets

WASHING FACILITY

CROSS-REFERENCE TO RELATED APPLICATIONS

This application is a continuation-in-part of my copending application Ser. No. 08/612,370, filed Mar. 7, 1996, which in turn is a continuation-in-part of my application Ser. No 08/511,141, filed Aug. 4, 1995, now abandoned which in turn is a file-wrapper-continuation of my application Ser. No. 08/222,455, filed Apr. 4, 1994, now abandoned all three of the identified applications being incorporated by reference herein.

FIELD OF THE INVENTION

The present invention pertains to a washing facility and more particularly to a water receptacle, such as a sink or bathtub, and to the supply and drainage of water to and from the receptacle.

BACKGROUND

A plumbing installation for a washing facility, such as a vanity or bathtub, includes three main parts, namely, the inlet or water supply, the reservoir or water receptacle, and the outlet or water drain. In the typical installation, these three elements are three separate fixtures, or possibly subassemblies that are separately manufactured, delivered and interconnected either to a limited extent during the manufacturing process but at the job site.

Notwithstanding proper planning and design, such separate fixtures usually do not completely blend with each other although each may have appealing features per se. Even after interconnection, these elements often retain an undesirable measure of individuality instead of blending into a unified whole. Moreover, there are significant advantages to integrating these elements or their functions, that is by prefabrication and pre-plumbing, prior to arrival at the job site.

Conventional vanity and tub installations and their components have several disadvantages as described below and which inherently detract from desired functional and aesthetic integration, as well as individual operation, apart from the impediments to prefabrication and pre-plumbed fixtures.

The shapes of conventional water receptacles, such as sinks and bathtubs, are defined by compound curves thereby requiring manufacture by deep drawing, casting, or other processes involving expensive equipment, tooling and molds. Moreover, the provision for adjacent decking having horizontal surfaces normally requires more labor to install, including joining to the water receptacle by seams and the necessary trim. Also, the differences in material and finish between the water receptacle and the adjacent decking may represent aesthetic and functional compromises.

Another disadvantage of conventional vanities and bathtubs is the relative location of inlet and drain. Normally, the drain is located on the bottom of the receptacle, almost directly below the inlet and near the place where the water strikes the basin floor. Since the water in a conventional faucet is a cylindrical, nearly vertical stream, there is little opportunity for any natural washing of the surface of the receptacle by the water on route to the drain. Such conventional location also has an aesthetic disadvantage in that the drainage hole is conspicuously visible and thus detracts from the overall appearance of the installation.

A conventional faucet normally comprises handles, a valve or valves, and a spout. These three components are either integrated into a single unit, or the spout is separate from the other two. In any event, conventional faucets are typically separate from the water receptacles. Since the faucet handles must be manipulated by the user, they are of course surface mounted and exposed, but surface mounting of the entire faucet is not necessary and occurs more for reasons of convention than for optimum function. It has been conventional to separate the faucet and receptacle because this does allow the use of virtually any faucet with any receptacle, but there are several distinct disadvantages.

One disadvantage is the cost of providing finished housings for all exposed components. Providing a surface mounted spout with protected and concealed valves requires one, two, or more frequently, three separate housings, in addition to the handles. By far, the greatest cost associated with faucets relates to these housings.

Another disadvantage is the requirement for cleaning. Such faucet housings are normally of bright metal and are located where they are most exposed to dripping and splashing of soapy water. They present a routine cleaning chore that is separate and often more difficult than cleaning the basin itself This is especially true with certain finishes, in coastal environments, or in the presence of certain chemicals in the water. Moreover, the seams between the housings and the mounting surface present a particular maintenance problem since they are difficult to clean and hence are often the source of eventual corrosion.

A third disadvantage is lack of safety. Conventional spouts overhang and project into the basin or bathtub, creating an often angular obstruction to be avoided. In addition to the occasional irritation of bumping hands or head or other limb on the spout, there is a danger of more serious injury. For example, a playful child; a person moving about with soap in the eyes; or an elderly, handicapped, or careless person may slip and fall against the protruding portion. Overhanging spouts also compromise the utility of the wash basin by interfering with the lowering of one's head into the basin as far as may be desired for rinsing the face or hair or even for rinsing the mouth or for taking a drink if a glass is not handy. In addition, since most spouts direct the water in a substantially vertical column directly from the spout to the drain, the user must intercept the water and splash it against the face, not only compromising the washing function, but also splashing water on surrounding surfaces.

Yet another disadvantage pertains to aesthetic considerations. Mounting one or more objects, such as the spout fixture, valve and handles on or adjacent to the water receptacle creates a visual clutter which in form and material may detract from the clean lines of the water receptacle itself Stylized faucet housings do not completely disguise the spout's function as a pipe or the handles' function as valves.

In addition, the conventional stopper mechanism for the drain, in both bathtubs and wash basins, is a multipart drain assembly including a stopper valve or plug, an actuator handle (such as a lever or pull rod), and a linkage between the valve and the handle. Quite often, this mechanism, especially because of the relatively complex linkage, does not function properly, and requires repair or replacement, or is simply not used. Since the handles of stopper mechanisms are usually incorporated in the faucet bodies, and since a stopper mechanism is not always desirable, as in commercial installations, manufacturers must make, and dealers must order or stock, duplicates of many styles of faucets with and without actuator handles, especially for such commercial installations.

A further disadvantage is that the drain fitting located in an outlet hole at the bottom of the sink or bathtub is normally of a bright metal and forms a raised and overlapping flange as well as exposed seams between the fitting and the receptacle. This material and construction results in cleaning and corrosion problems similar to those described above with regard to faucets. This problem is exacerbated in that the drain fitting is the part of the installation most susceptible to debris and resultant staining while at the same time being the most difficult to clean by virtue of its shape and finish.

Several patents disclose efforts to solve certain of these problems pertaining to one of the components of a washing facility, but no prior art is known that brings together solutions to all of the above described problems for a vanity or bathtub in an integrated and interrelated manner. For example, one or more of the U.S. Pat. Nos. 2,105,944 to Graf, 2,564,190 to Danielson, 2,767,407 to Weiss; and 3,156,931 to Holtman disclose efforts to solve certain of the above described problems of the water receptacle, but none provides a complete solution nor is any suited for the construction of modern vanities and baths. The U.S. Pat. Nos. 3,156,931 to Holtman; and 4,991,241 to Bergmann et al. disclose inlets not using surface mounted spouts, but these do not meet modern code requirements nor do they address several of the other problems. The U.S. Pat. Nos. 2,052,565 to Groeniger; 2,171,133 to Stanton, and 2,243, 204 to Groeniger each removes the drain hole from the bottom wall of a bathtub, but they all use an actuator handle and the types of linkages between the stopper valve and the handle that are either subject to failure or are difficult to remove and/or clean. In general, the known prior art does not provide an integrated washing facility incorporating solutions to the above described problems and which may be either a vanity or a bathtub.

SUMMARY

A washing facility is provided that includes a washing receptacle incorporating inlet and outlet functions, that is constructed to enable water supply and drainage units to be pre-plumbed with the receptacle, and that removes the undesirable projection of spouts and handles into the washing area. The receptacle is fabricated of sheet material with deck portions and in its preferred embodiment has a pair of vertical front and rear planar walls joined by an imperforate arcuate central wall. The rear wall has a flush upper inlet, and the front wall has a flush upper overflow and a flush lower outlet. The inlet is visible, but the overflow and outlet are obscured, from vantage points in front of the facility. The water supply unit is attached to the exterior of the receptacle over the inlet and under the deck and includes a water shaping nozzle for ejecting water from the inlet in an arcing laminar sheet. Hot and cold water valves are connected to the nozzle and are adapted to be connected to water supply conduits at the jobsite. The water drainage unit is also attached to the exterior of the receptacle and has a chamber over the overflow and the outlet, a stopper slidably movable between positions opening and closing the outlet, and a drain conduit leading from the chamber for connection to waste lines at the jobsite. Two valve handles are slidably mounted in side-by-side relation on the deck and are individually connected to the valves for opening and closing the valves. A stopper handle is located on the inner surface of the receptacle and is attached to the stopper for moving the stopper between its open and closed positions.

An object of the present invention is to integrate certain functions and to simplify the visible structure of washing facilities, such as vanities and bathtubs.

Another object is to improve the supply, retention and drainage functions of a water receptacle in such washing facilities.

A further object is to reduce the cost and complexity of manufacturing, distributing and installing such washing facilities.

An additional object is to provide integrating features for a washing facility that are equally adapted for use in either a vanity or a bathtub.

Another object is to simplify the surface construction of a washing facility thereby to facilitate maintenance, to reduce accidents in its use, and to improve its appearance.

Yet another object is to provide a washing facility that does not have overhanging spouts and projecting handles which in conventional washing facilities obstruct the use of the facility by preventing the user from moving one's head and limbs freely into and out of the water receptacle.

An additional object is to reduce the cost of a washing facility by fabricating the water receptacle of sheet materials such as metals and plastics.

Another object is to obscure and conceal unattractive but essential elements of a washing facility while retaining their functions.

A still further object is to locate the inlet, outlet and drain of a water receptacle so that the water stream entering the receptacle naturally contributes to the cleaning of the receptacle while enhancing the operational aesthetics of the facility.

Yet another object is to enable a washing facility to be pre-plumbed prior to delivery to a job site.

An additional object is to eject a smooth arcing laminar sheet of water from the inlet of a water receptacle while preventing back flow through the inlet.

Another object is to reduce the complexity and to improve the dependability and functionality of a drain mechanism.

These and other objects will become apparent upon reference to the following drawings, description and appended claims.

DETAILED DESCRIPTION

Figure 1:
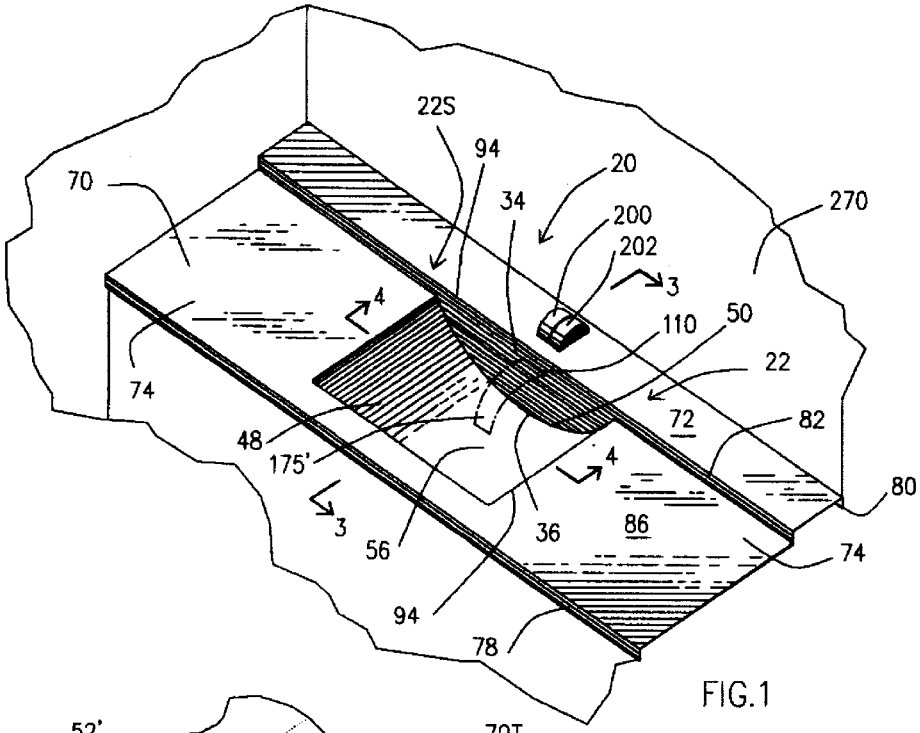
FIG. 1 is an isometric view of a vanity incorporating the principles of the present invention and shown as installed in a building construction.

With particular reference to FIGS. 1 through 5 and 10, a washing facility constructed in accordance with the present invention is generally identified by the numeral 20. The subject washing facility has three principle parts, namely, a water receptacle 22 which may be a sink 22S or a bathtub 22B, a water-supply unit 26, and a water-drainage unit 30. The following detailed description will refer primarily to the sink 22S and which is shown in a vanity in FIG. 1, but the principles of the invention are equally applicable to a bathtub. The fundamental characteristics of a sink, or wash basin, and a bathtub are the same, insofar as the present invention is concerned, and each has similar problems regarding the supply, retention and drainage of water. Although these functions are conventionally separated, there are significant advantages in greater integration of such functions as accomplished by the present invention and as explained herein.

Referring particularly to FIGS. 1 and 3 through 5 and 10, the sink 22S is constructed of sheet material, such as metal or plastic, and in a manner subsequently described in greater detail. The sink has a vertical, planar rear wall 34 having a curved lower edge 36 and a straight upper edge 38. The sink also includes a vertical, planar front wall 40 in forwardly spaced parallel relation to the rear wall and also having a curved lower edge 42 and a straight upper edge 44. In between the rear and front walls is a U-shaped intermediate wall 48 having curved front and rear lower edges 50 respectively joined to the lower edges of the front and rear walls; straight transverse upper edges 52 which are in spaced parallel relation across the span of the sink; a bottom 56; and curved end portions 58 which join respective upper edges 52 and the bottom 56. In the case of the sink, the intermediate wall is continuously curved from one upper edge to the other about a single axis above the sink; the bathtub of course differs in this respect. Also, for subsequent reference, the sink has an inner surface 60 and an outer surface 62. The intermediate wall is smooth on its inner surface and completely imperforate throughout its entire area.

Figure 3:
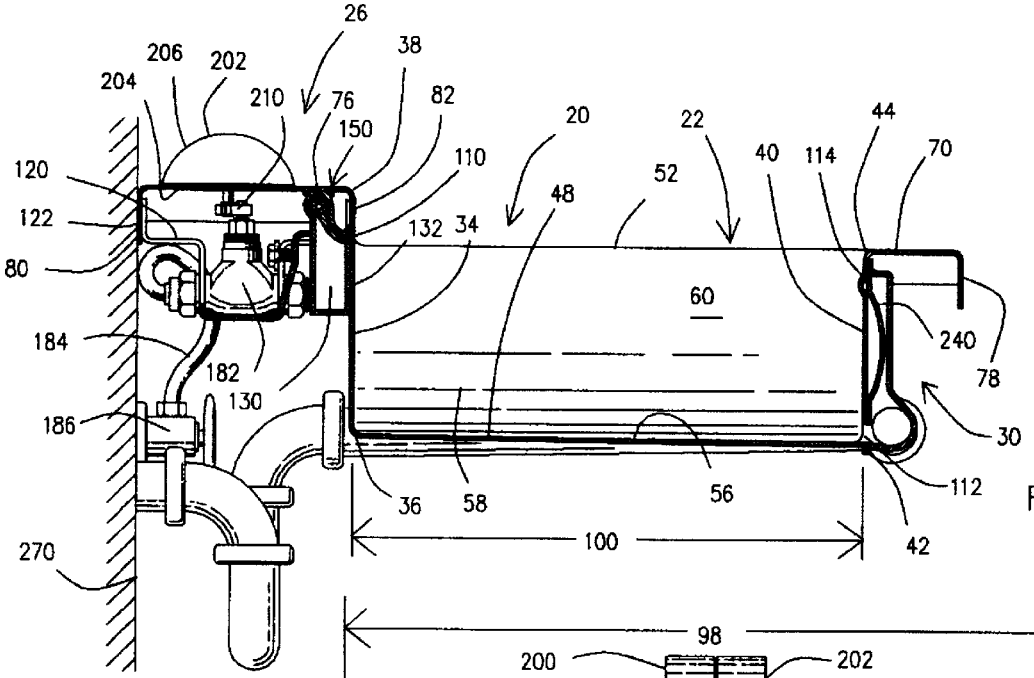
FIG. 3 is an enlarged transverse vertical section taken on line 3—3 in FIG. 1.
Figure 4:
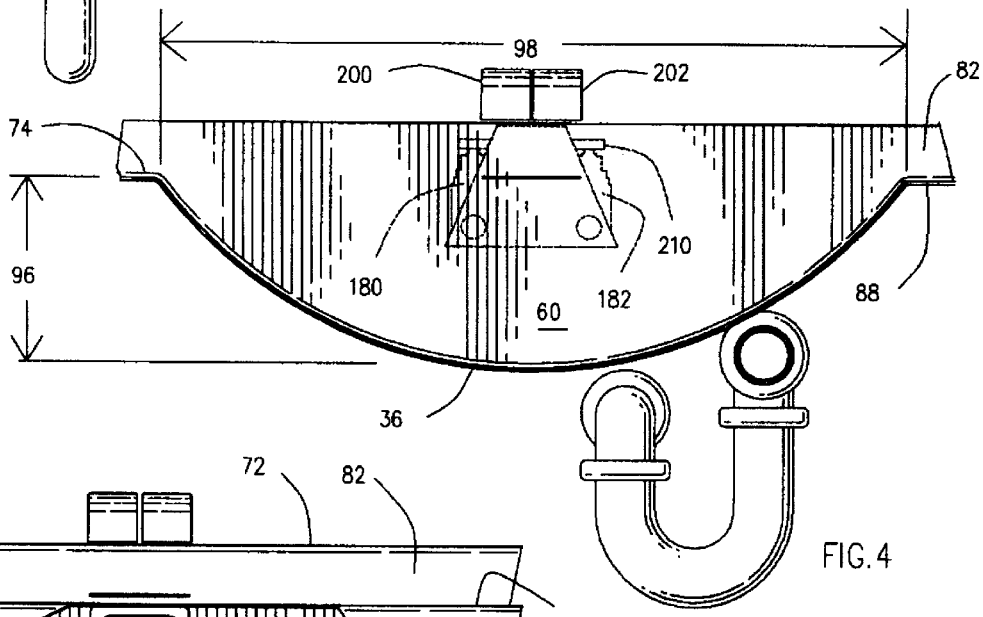
FIG. 4 is an enlarged fragmentary longitudinal vertical section taken on line 4—4 in FIG. 1 and showing certain hidden parts in dashed lines.

The sink 22S (FIGS. 1, 3 through 5, and 10) also includes upper front and rear deck or counter portions 70 and 72, lateral deck portions 74 and 76, a front fascia 78, a rear mounting flange 80, and a rear riser 82. Again, for subsequent reference, the deck portions have a top surface 86 and a bottom surface 88. The front and rear deck portions and the lateral deck portions join the upper edges 38, 44, 52 of the front, rear, and intermediate walls 40, 34, 48 in junctures that together define a rim 94 of the sink, albeit the rim continuity is interrupted in the disclosed embodiment by the riser. As best shown in FIG. 3, the junctures of the deck portions and the front and rear walls are essentially right angular so that the front and rear walls extend straight down vertically from the deck portions. As best seen in FIG. 4, however, the intermediate wall joins the deck portions at the rim in generally obtuse angles. In any case, when the material is metal, the radius of the bends at each of these junctures along the rim is minimal. Although the invention is not so limited, the height 96 of the sink is preferably five inches, the length of the span of the sink 98 is preferably twenty inches, and the width 100 is fourteen inches.

The rear wall 34 (FIGS. 1 and 3 through 10) has an upper, substantially horizontal, water inlet 110 (FIGS. 1, 4 and 5) that is an elongated and very narrow rectangular slot or slit and that is relatively closely spaced below the rim 94. This slot extends through the wall from the inner surface 60 to the outer surface 62. In the preferred embodiment, the height or width of the inlet is 3/32 inch and its length is two and a quarter inch for the sink 22S and eight inches for the bathtub 22B. As will be understood by reference to FIGS. 1 and 3 in particular, this inlet is quite visible from any vantage point in front of the washing facility 20 to an adult of average height.

Figure 8:
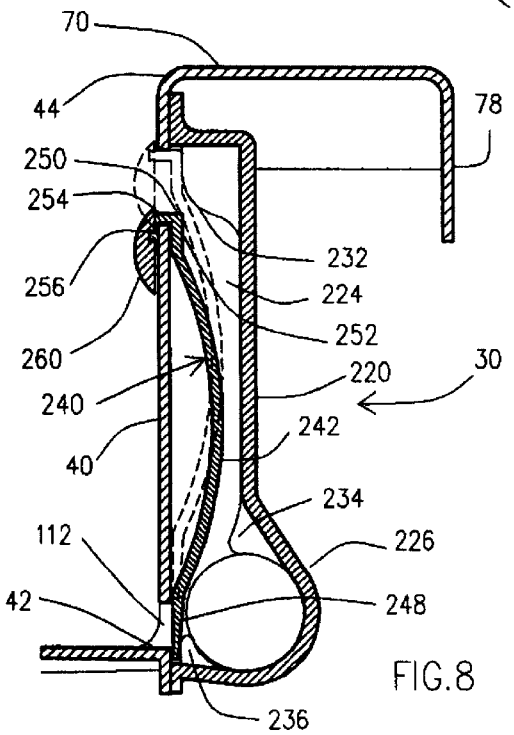
FIG. 8 is an enlarged section of the water drainage unit of FIG. 3.
Figure 7:
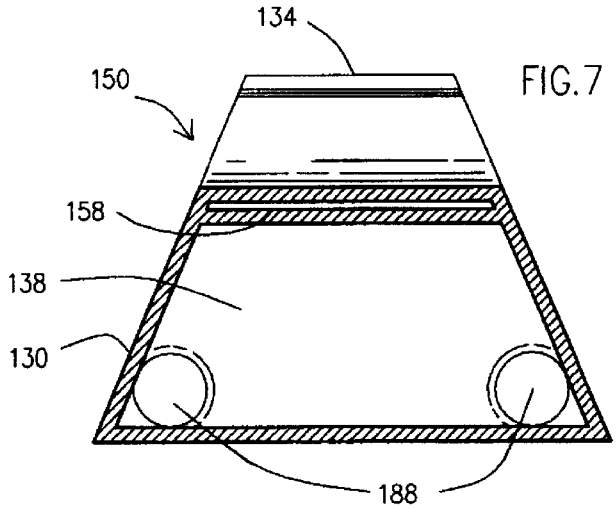
FIG. 7 is a vertical longitudinal section taken on line 7—7 in FIG. 6.
Figure 10:
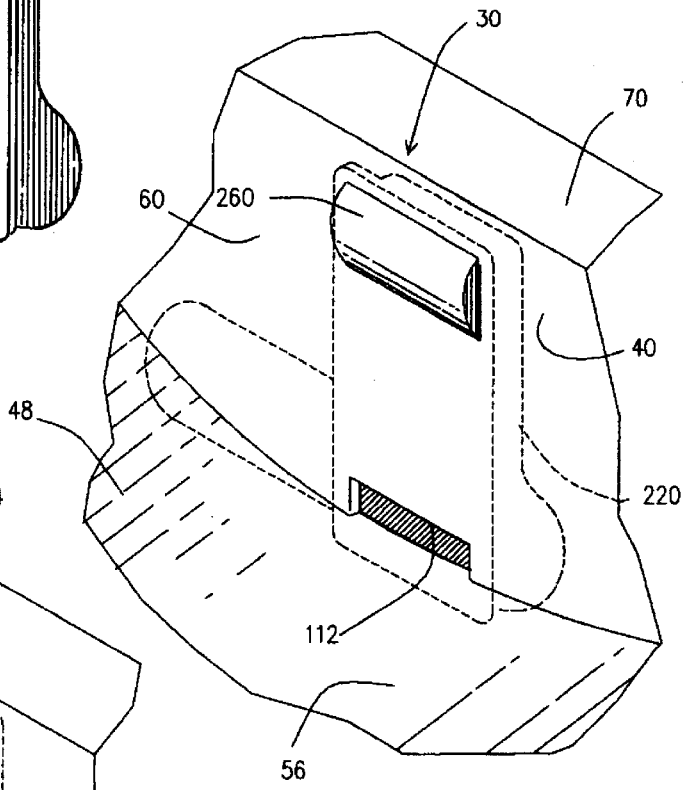
FIG. 10 is an enlarged fragmentary isometric of the sink of FIG. 1 showing the water drainage unit with its stopper in open position.
Figure 11:
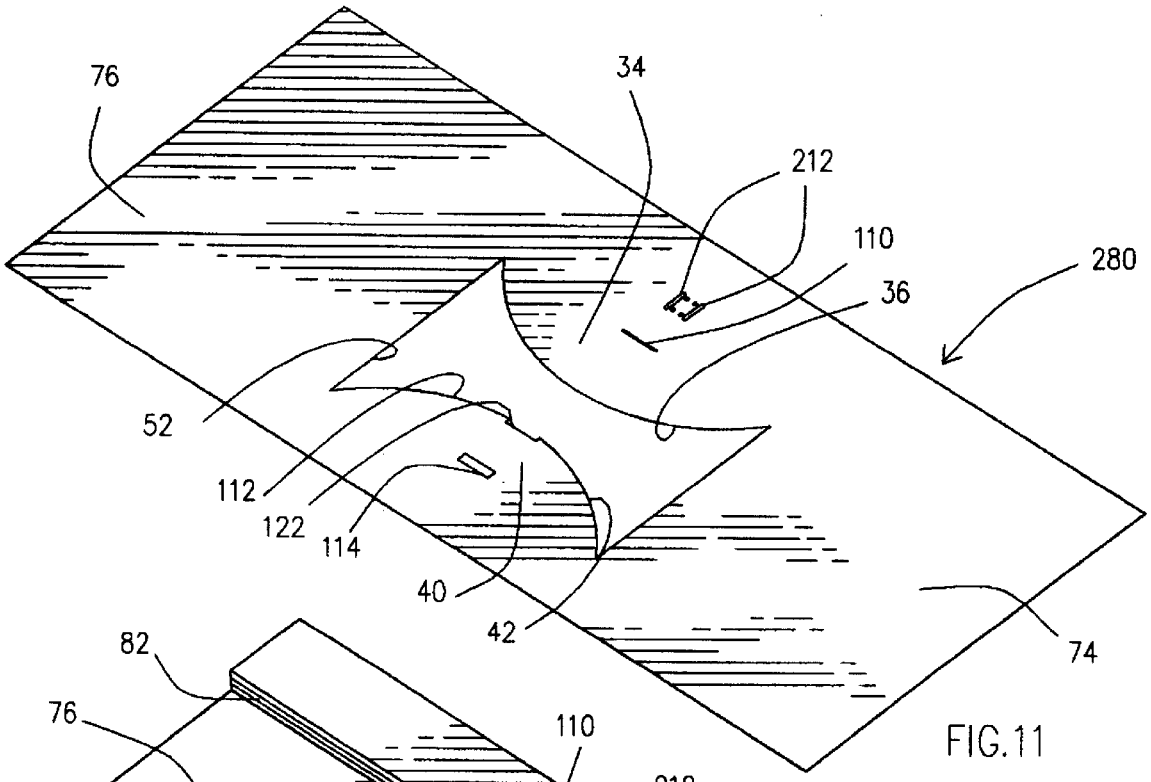
FIGS. 11 and 12 are isometric views showing how the water receptacle of the present invention is fabricated in a metal material.

The front wall 40 of the sink 22S has a lower, substantially horizontal, rectangular drain outlet 112 (FIGS. 3, 8, and 10). This outlet is actually formed in the lower edge 42 of the front wall as best seen in FIGS. 3, and 11. The front wall also has an upper, substantially horizontal rectangular overflow 114 (FIGS. 3, 8 and 10) that is preferably of the same size and shape as the drain outlet and also extends through the front wall from its inner surface 60 to its outer surface 62.

The inlet 110, the outlet 112, and the overflow 114 are all in general alignment with a vertical plane passing transversely through the intermediate wall and about which the sink and the washing facility as a whole are symmetrical. As best seen in FIG. 3, the bottom 56 of the intermediate wall 48 is sloped from the lower edge 36 of the rear wall 34 toward the outlet approximately one-eighth inch in the preferred embodiment so that the bottom has a generally conical shape, a shape relatively easy to achieve in bending metal or shaping plastic. Available sheet metal equipment, for example, can readily bend or roll a conical surface, whereas spherical surfaces or other compound curves are much more difficult to achieve. Such construction is also incorporated in the bathtub 22B, although not shown in detail.

The water-supply unit 26 (FIGS. 3 through 7) includes a mounting bracket 120 having a rear flange 122 secured to the rear mounting flange 80 of the deck portion 72, a front flange 124, and an intermediate saddle 126. A frusto-pyramidal housing 130 (FIGS. 3, 4 and 7) is disposed forwardly of the front flange and includes a front panel 132 secured to the outer surface 62 of the rear wall 34 of the sink 22S, a top portion 134 secured to the outside surface of the rear deck portion 70, and a rear panel 136. The housing encloses a combined mixing and settling chamber 138, and the rear panel has lower hot and cold inlet openings 140 leading into this chamber.

The water-supply unit 26 (FIGS. 6 and 7) also includes a nozzle 150 formed within the housing 130 by the top portion 134 and an internal baffle 152. The nozzle has a goose-necked shaped passageway 154 of nearly the same rectangular cross-sectional size and shape as the water inlet 110, but slightly smaller, so that the stream of water flowing from the nozzle through the inlet does not contact the edge of the inlet, and thus the inlet edge does not affect the flow except at very low volume. This passageway has an outlet 158 in congruent communication with the inlet 110, an upper apex 160, and an inlet 162 communicating with the mixing chamber 138 but offset from the inlet openings 140. It is to be noted that the passageway need not be goose-necked shaped but may merely have its inlet essentially at the apex; the main point is that the apex be a predetermined distance above the outlet 158. Although the present invention is not limited to specific dimensions, it is significant in accordance with local plumbing codes that the distance between the outlet 158 and the apex 160 of the passageway is a minimum of one inch, that is, there is a one-inch rise provided for by the passageway to protect against back-flow from the sink into the water supply.

A feature of the water-supply unit 26 to be noted is how the water flow is controlled to achieve the desired shape of the stream exiting from the inlet. Thus, hot and cold water enters the mixing and setting chamber 138 through inlet openings 140 at relatively high velocity, not conducive to the desired shaping of the water flow from the inlet 110. From the chamber, the water enters the inlet 162 of the nozzle 150 at a position offset from the direction of the flow entering the chamber, and at a lower velocity that allows shaping in the passageway 154 for exit through the inlet 110 into the sink 22S in an arcing laminar sheet 175.

The mounting bracket 120 also includes a clamping arm 170 which bears against the housing 130 and presses the front panel 132 against the rear wall 34 and thus presses the outlet 158 of the passageway 154 in fluid-tight communication with the inlet 110. Although not shown, a neoprene O-ring or gasket may be employed if necessary around the communicating outlet 158 and inlet 110 to ensure a water-tight seal between the mating surfaces. Compression is adjusted and maintained by a clamping bolt 172 threaded through a portion of the bracket and bearing against the clamping arm.

Hot and cold water valves 180 and 182 (FIGS. 3, 4 and 6) are mounted in the saddle 126 of the mounting bracket 120 and are secured thereto. Inlet hoses, as 184, interconnect the main water line 186 to inlet fittings 188 on the valves. The valves also includes outlet fittings 190 respectively connected to the inlet openings 140 of the housing 130 and rotatable stems 194 which project upwardly in closely adjacent spaced relation to and under the exterior surface 62 of the rear deck portion 70.

With particular reference to FIGS. 1, and 3 through 6, valve handles 200 and 202 are mounted on the outer surface 62 of the rear deck portion 70 in side-by-side relation for fore and aft sliding movement. In the preferred embodiment shown in FIG. 1, the handles are on opposite sides of the vertical plane referred to above with which the inlet 110, the outlet 112, and the overflow 114 are in general alignment. The handles have flat undersurfaces 204 and arcuate rounded top surfaces 206 that are curved about an axis extending transversely of the path of sliding movement of the handles. In addition, the handles are individually connected by linkages 210 which extend through openings 212 (FIGS. 11 and 12) in the rear-deck portion 70 to the valve stems 194. Preferably, the handles are connected to the linkages by a snap fit. Sliding movement of the handles to and fro rotates the valve stems and causes the hot and cold water valves to open and close. Thus movement of the handles in one direction causes increased projection of water from the inlet 110 and movement in the opposite direction caused decreased projection of the stream of water. A more detailed description of these handles, their linkages, and the valves is provided in the copending applications referred to above in the opening paragraph and incorporated herein by reference.

Figure 5:
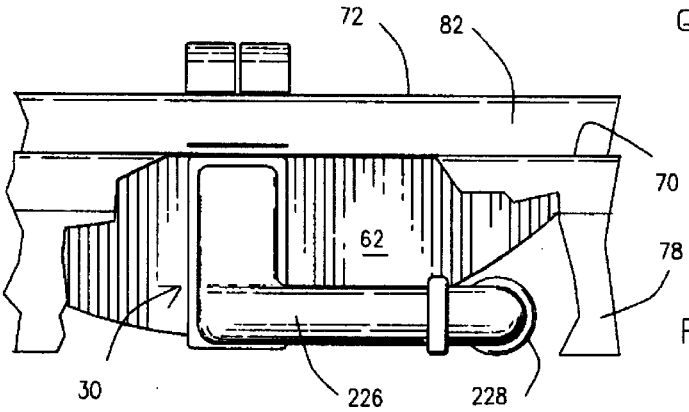
FIG. 5 is an enlarged fragmentary front elevation of the vanity shown in FIG. 1 but with parts broken away to show the water drain unit.
Figure 6:
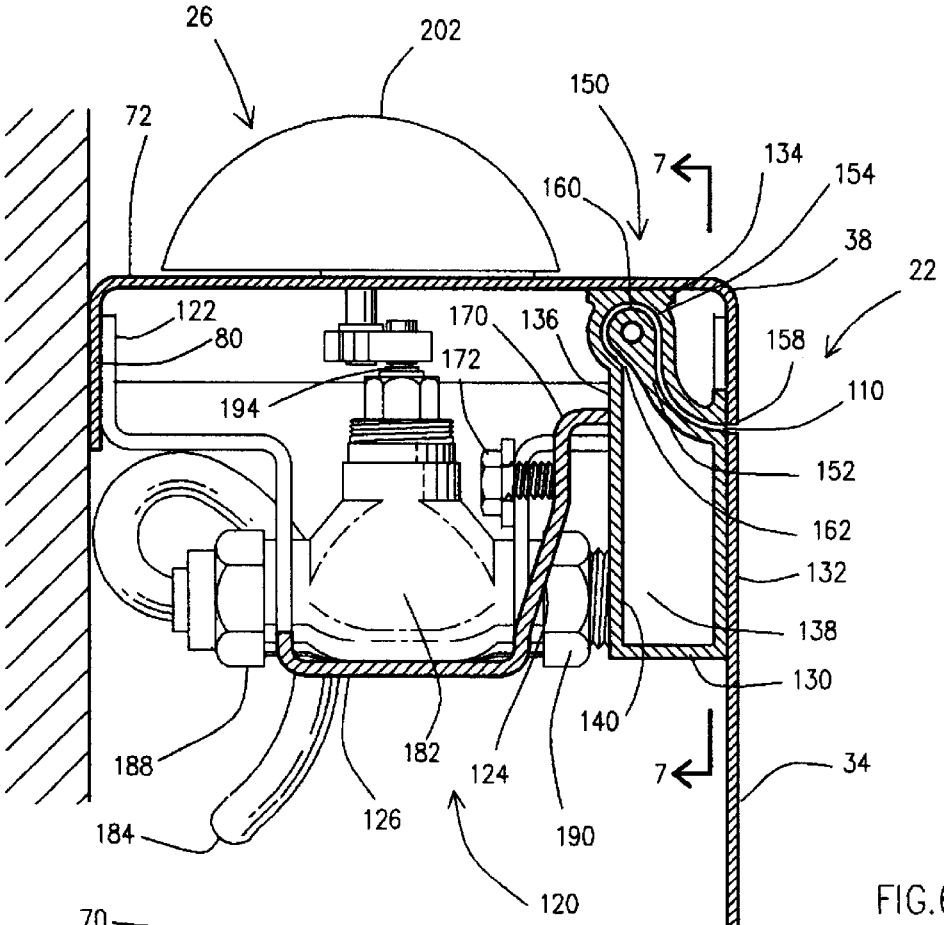
FIG. 6 is an enlarged section of the water supply unit of FIG. 3.

The water drainage unit 30 (FIGS. 3, 5, 8 through 10, 10A) includes a generally rectangular drainage housing 220 having a circumferential flange 222 which is secured to the outer surface 62 of the front wall 40 thereby defining a drain chamber 224 with the front wall. The drainage housing also provides a lower, substantially horizontal drain tube 226 extending laterally from the chamber (FIGS. 5 and 10). The drain tube is slightly sloped away from the drain chamber, and a drain pipe 226 interconnects the drain tube with a main drain line 228.

The drainage housing 220 has sufficient length and width to fit over the overflow 114 and the outlet 112 so that the latter are enclosed by the housing and in communication with the drain chamber 224. The drainage unit 30 also includes transversely spaced, upper restraining tabs 232 in the upper corners of the drain housing, transversely spaced lower guide tabs 234 adjacent to the upper edge of the drain tube 226, and transversely spaced, lower compression tabs 236 in the lower corners of the drainage housing.

Figure 9:
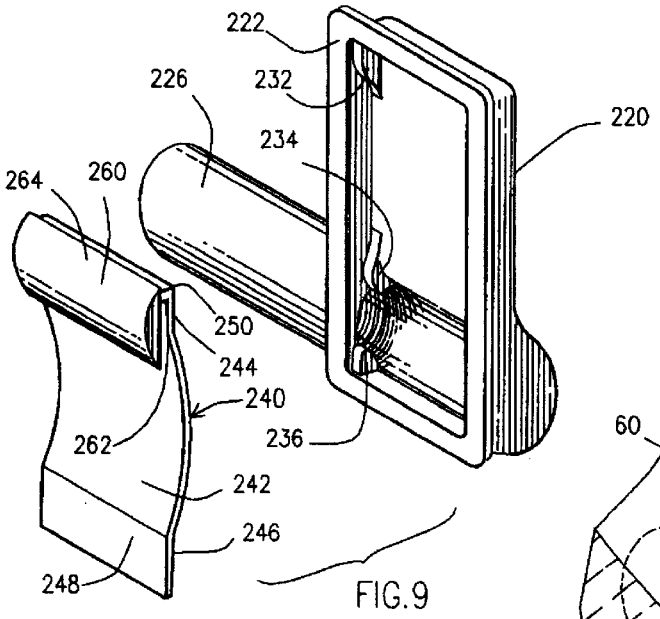
FIG. 9 is an exploded isometric of the water drainage unit of the present invention.

The water drainage unit 30 (FIGS. 8 through 10A) also includes a one-piece stopper 240, preferably of a durable plastic such as nylon, and may be resiliently flexible or rigid. The stopper is rectangular in plan view and has a length and width allowing it to fit within and move longitudinally of the drainage housing 220. The stopper has an elongated arcuate main body 242 which is preshaped in a longitudinally concavo-convex shape, as shown in FIG. 9, and has an upper end 244 and a lower end 246. The stopper also has a lower, planar, rectangular gate 248, of similar shape but slightly greater area than the outlet 112, at the lower end of the body and in slidable engagement against the outer surface 62 of the front wall 40 of the sink 22S adjacent to the outlet. In addition the stopper terminates in an upper, U-shaped guide 250 at the upper end of the body having an inner flange 252 which is coplanar with the gate and, like the gate, is slidable against the outer surface 62 of the front wall 40. The guide also has an intermediate horizontal stop flange 254 extending into the overflow 114 and an outer vertical standoff flange 256 located just inside the inner surface 60 of the sink.

Figure 10A:
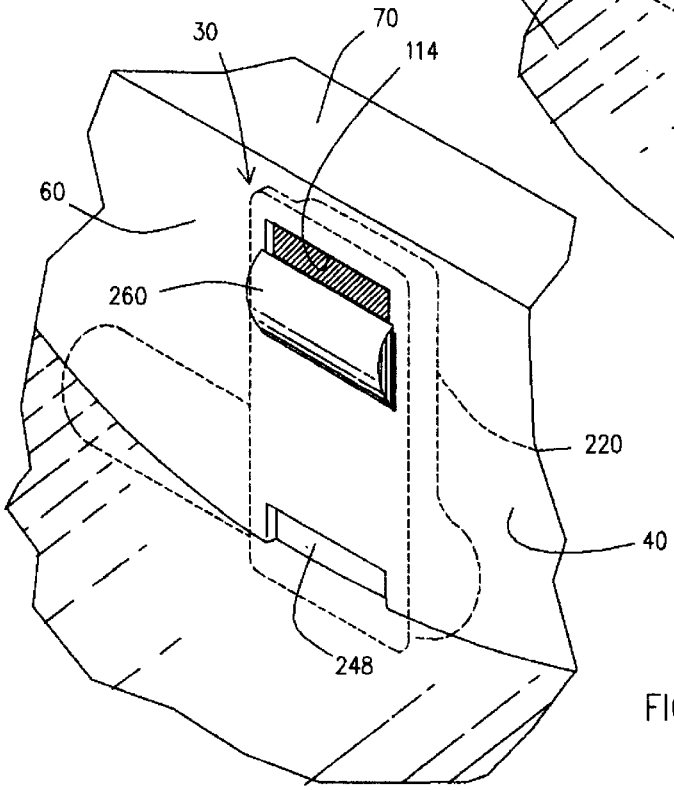
FIG. 10A is a view similar to FIG. 10, but showing the stopper in its closed position.

A stopper handle 260 (FIGS. 8 through 10A), preferably made of metal, has a flat undersurface 262 secured, preferably with a snap fit, to the standoff flange 256 of the stopper 240 and an arcuate rounded top surface 264. The profile of the stopper handle is similar to, but smaller than, the profile of each of the valve handles 200 and 202. Like the valve handles, the top surfaces 264 is curved about an axis that extends transversely of the path of sliding movement of the stopper handle, it being noted that in the preferred embodiment such axis is parallel to the similar axis referred to above for the valve handles so that the movements of all three handles are coordinated and intuitive. In other words, the similar shapes of the handles and their parallel relationship provides the user with both a visual and tactile characteristic which intuitively suggests to the user how to apply force to slide the handles between open and closed positions. By pressing the stopper handle down or by lifting it up, the stopper 240 can be moved between an open position, as shown in FIG. 10, wherein the stopper handle covers the overflow 114 and the outlet 112 is exposed and a closed position wherein the gate 248 is in sealing engagement over the outlet while the overflow is exposed, as shown in FIG. 10A. It should be noted, however, that exposing and covering the overflow is a preferable but optional feature. The compression tabs 236 press the gate 248 into a sealed position over the outlet 112 but allow release upon upward pressure on the stopper handle. The restraining tabs 232 prevent the stopper from being pushed into the overflow 114 in the normal drain-open or upper position. The body 242 is arched to enable insertion and removal of the stopper through the overflow by a combined vertical and rotational movement. Of course, the length of the stopper from the upper stop flange 254 to the bottom edge of the gate 248 is slightly longer than the distance between the bottom edge of the overflow and the bottom edge of the outlet and is slightly wider than the overflow thereby to overlap the outlet in the closed position. The stopper, however, is not as wide as the overflow thereby to allow the described insertion and removal of the stopper through the overflow. The standoff flange 256 of the guide 250 mounts the stopper handle in spaced relation to the inner surface 60 of the front wall 40 so that the handle does not contact the inner surface as the stopper is moved between its upper and lower positions.

Figure 2:
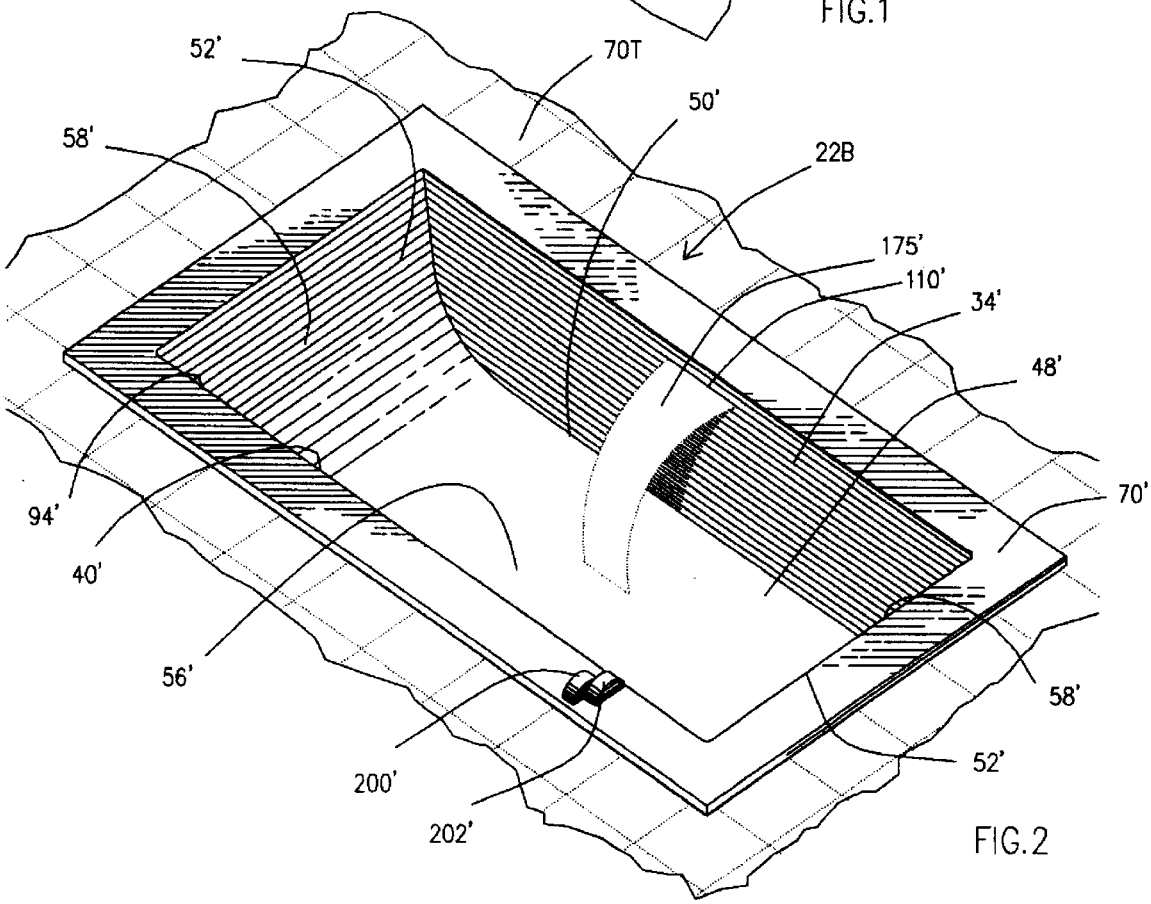
FIG. 2 is an isometric view of a bathtub also incorporating the principles of the present invention.

Brief reference is now made to the principles of the present invention when the water receptacle 22 is a bathtub 22B (FIG. 2). The bathtub has an integral deck 70' set in a separate outer tile deck 70T. The tub has a vertical rear wall 34' and a front vertical wall, not seen, extending down from a rim 94' just as in the front wall 40 of the sink 22S. In the tub, however, an intermediate wall 48' has end portions 58' and an elongated bottom or floor 56' which is substantially flat between the end portions, although still sloping slightly toward an outlet, not shown, but in the same relative location in the front wall of the tub as its counterpart outlet 112 in the sink 22S. The end portions 58' are either vertically planar or else are sloped to form backrests; in the later case, each end portion includes an upper planar section slightly angled endwardly away from vertical and a lower curved section joining its planar section and the bottom portion in smooth tangential transition. The rear wall has a slotted inlet 110', and the front wall has both an overflow and an outlet in the same relative locations as their counterparts in the sink.

A water supply unit, not shown, but similar to the unit 26, is mounted under the deck 70' and includes hot and cold water valves, not shown. The valves are connected by conduits, not shown, to a housing, not shown, but like 130, which is secured to the outside of the tub 22B in fluid communication with the inlet 110'. Inlet hoses, not shown, are connected to the valves for supplying water from the main lines 186 to the valves. Handles 200', 202' are mounted on the front portion of the deck, or on a coverplate, not shown, and are coupled to the valves through openings in the deck. The water supply unit produces an arcing laminar flow 175' ejected from the inlet out over the sloped bottom 57 toward the outlet, not shown, as before. Here, the handles are located on the front deck portion, but as previously stated, the handles and the water supply unit or portions thereof may be placed in different selected locations, that is the handles at different locations on the deck 70' or 70T, and the supply unit at different locations under the deck. In other respects, the bathtub installation is the same as previously described with regard to the sink.

METHOD OF FABRICATION

Directing attention to FIGS. 11–14, the method of fabricating the water receptacles 22 in accordance with the present invention is now described with particular reference to the sink 22S but with incidental reference to the tub 22B. Only two sheets 280 and 282 are used to form the sink of sheet metal, preferably stainless steel, and ranging from sixteen to twelve gauge in thickness. The fabrication of only one sink is shown in the drawings, but a vanity with two or more sinks can readily be made.

Figure 12:
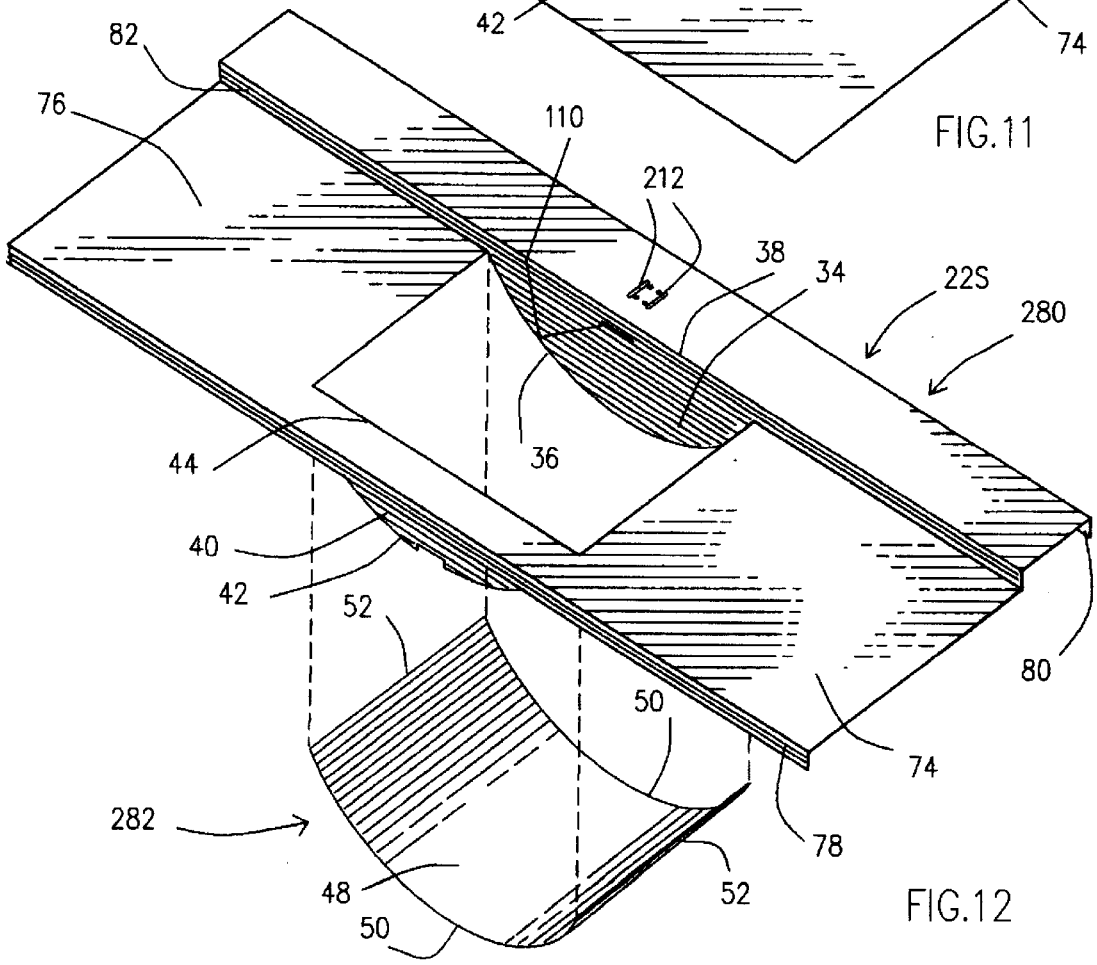

As shown in FIG. 11, openings 212; inlet 110, edges 36, 42, and 52; outlet 122; and overflow 114 are cut in the first sheet 280 in alignment along the common plane transversely of the sheet as above described. The sheet is then bent, as shown in FIG. 12, along the edges 38 and 44 to provide the rear and front walls 34 and 40 and to provide the front and rear deck portions 70 and 72, the rear riser 82, the mounting flange 80, and the front fascia 78. The second sheet 282 (FIG. 12) is rolled into the shape of the intermediate wall 48 including the conically shaped bottom 56. Next, the two sheets are assembled with the first sheet 280 by bringing the two together to form the upper edges 52 which are then made integral by welding and grinding the seam smooth. The tub 22B is fabricated in a similar manner, but from three sheets comprising front, rear and intermediate walls bent to form their respective deck portions, and then joined by welding.

Figure 13:
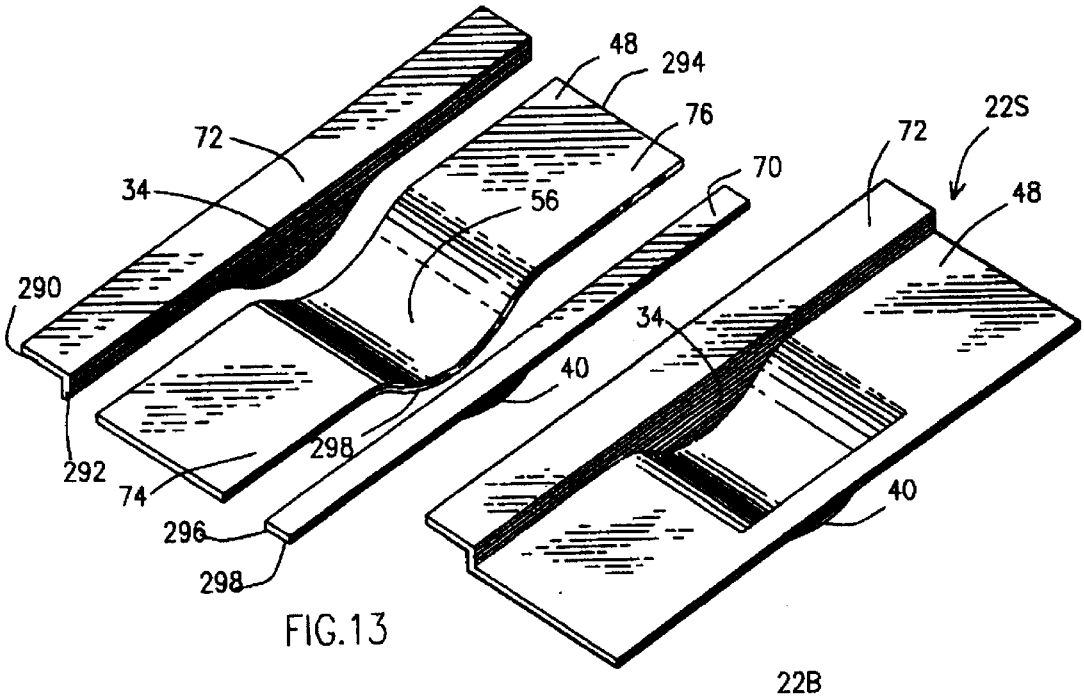
FIGS. 13 and 14 are isometric views showing how the subject water receptacle is fabricated in a plastic material.
Figure 14:
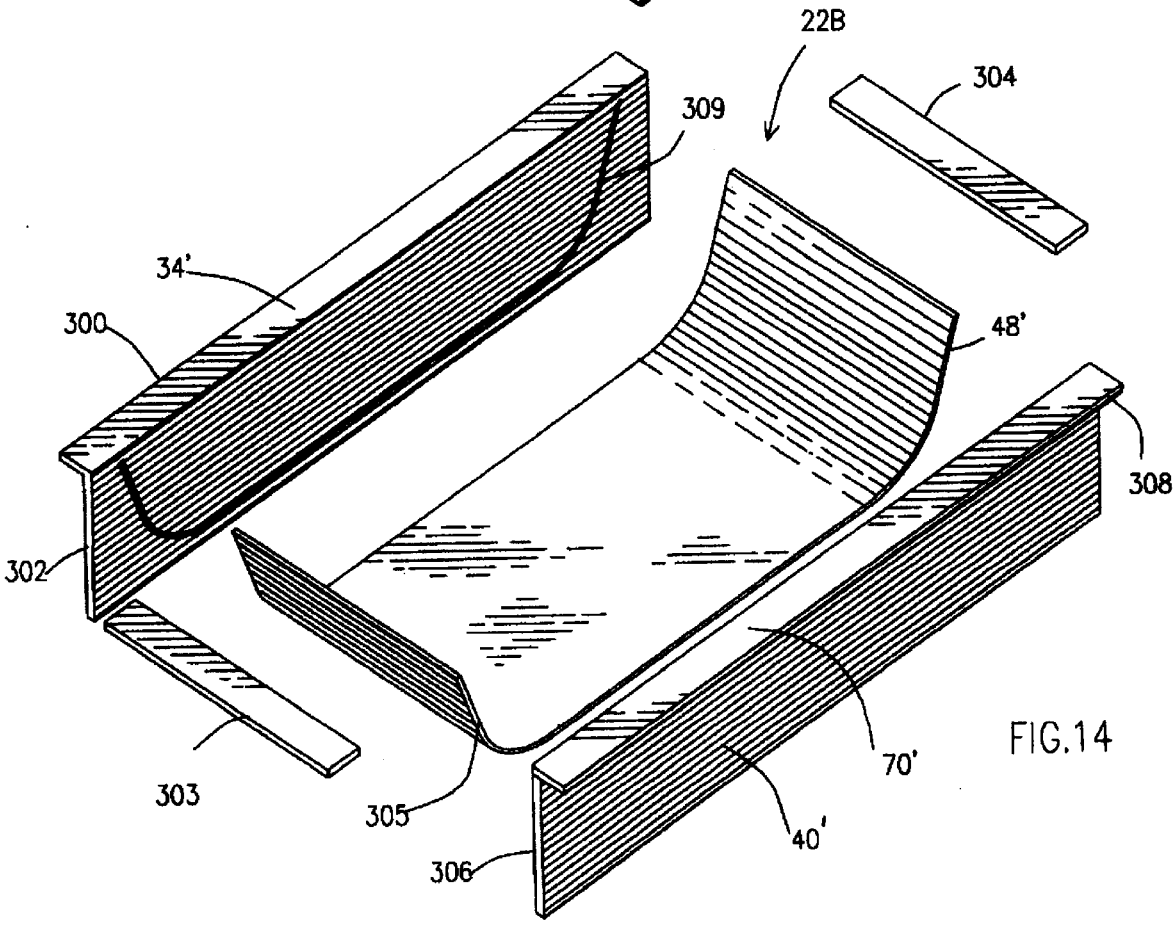

Alternatively, the sink 22S and the tub 22B may be formed from sheets or pieces of plastic, preferably acrylics and polymers, or a composite material such as acrylic resin and mineral fillers, in either case one-half inch sheets. The sink 22S is fabricated from five sheets or pieces 290, 292, 294, 296, and 298 (FIG. 13). The sheets 290, 292, 296, and 298 are cut by sawing into the shapes illustrated to form the front and rear deck portions 70 and 72 and the front and rear walls 40 and 34. The sheet 294, however, is heated and formed into the intermediate wall 48 and bottom 56 and with the lateral deck portions 74 and 76. In so doing, the bottom is shaped to provide the slight slope, as above described, toward the front wall 40 and thus toward the outlet 112 therein.

After the pieces or sheets 290, 292, 294, 296, and 298 are cut as above described, the sink 22S is then assembled as shown in the lower portion of FIG. 13. Thus, the pieces 290 and 292 are glued to provide the rear deck portion 72 and the rear wall 34; the pieces 296 and 298 are likewise glued to form the front deck portions 70 and front wall 40; and then these subassemblies are glued to the side edges of the intermediate wall 48 to form the completed sink as illustrated. Following each stage of gluing of the individual parts, the subassemblies, and the final assembly, they are clamped until the bonding is cured.

The bathtub 22B is similarly formed from plastic sheets or pieces 300, 302, 303, 304, 305, 306, and 308. Each of these pieces is initially cut from larger sheets of the described plastic material into the appropriate dimensions. Also, in this case, the inside surface of each front and rear wall is routed to provide a groove 309 in the shape illustrated in FIG. 14. The intermediate wall 48' is formed by heating the sheet 305 to provide the end portions 58' and the substantially flat but slightly sloped bottom 57, as previously described. After the sheets 300 and 302 are glued to form the rear deck portion 72' and the rear wall 34', and the sheets 306 and 308 are glued to form the front deck portion and the front wall 40, then these subassemblies 300, 302, 306, and 308, together with the pieces 303, 304, and 305, are placed into the final assembly forming the bathtub 22B.

Since the shapes of the sink 22S and the tub 22B have common geometric characteristics which do not involve the conventional compound curves, both receptacles 22 are similarly and simply formed as described. In contrast, the compound curves of conventional receptacles with spherical and other compound shapes are impractical to fabricate by such techniques. Using sheet material and walls which are planar or have simple curves, the receptacles of the present invention are fabricated of metal by bending flat sheets of metal followed by welding and smoothing by grinding, or of plastic by cutting, heating and forming sheets or pieces of the plastic and then gluing and smoothing. They, of course, can still be manufactured by conventional casting, vacuum forming, stamping, thermoforming, and the like, if desired. With metal construction, exterior and interior seams have minimal and uniform radii, the result of the bending process, or of fillet welding and grinding. With fabrication in other materials, such as plastics, strips of matching filler material are bonded to the joints and routed smooth, and seams are reduced to minimum lengths.

Such fabrication allows an alternate way to manufacture the receptacles 22, without costly tooling and equipment, and provides a degree of customization not possible with conventional techniques. The vanity, for example, may be made to custom lengths, with one or more sinks 22S positioned at any place along this length. Conventional top or undermount basins allow this flexibility, but only with the problems of non-integral basins. Vanities with integral basins and custom lengths are conventionally produced only in solid-surface acrylic and polymer materials, wherein cast basins are bonded to cut-out portions of flat sheets.

ALTERNATIVE EMBODIMENTS

Figure 15:
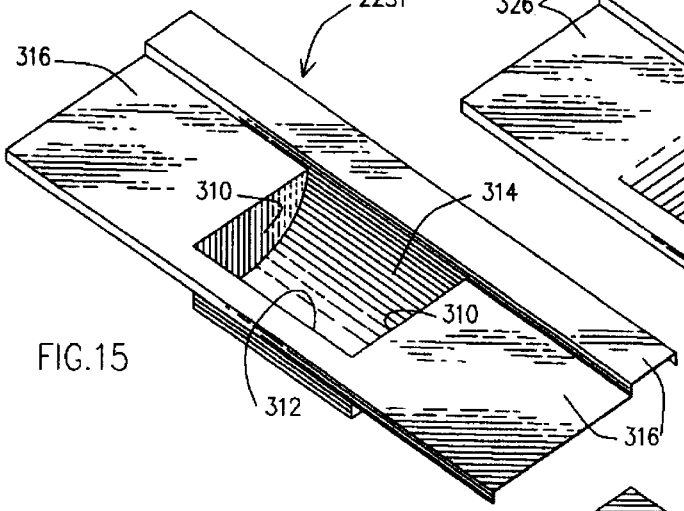
FIGS. 15 and 16 are isometric views of alternate embodiments of a vanity constructed in accordance with the principles of the present invention.
Figure 16:
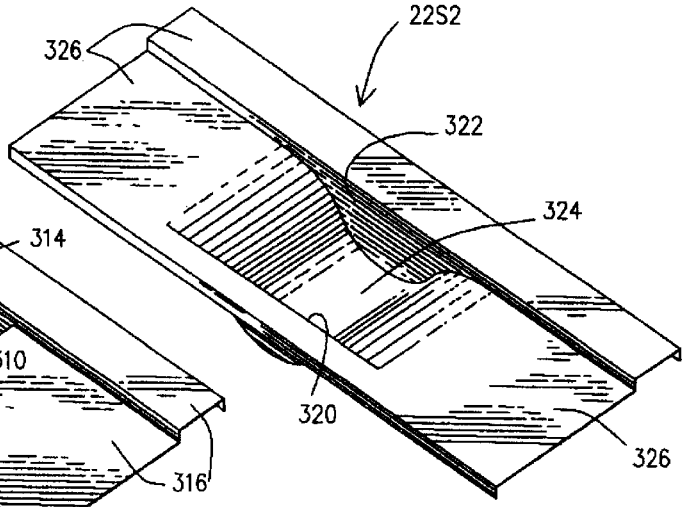

In FIGS. 15 and 16, alternative embodiments of the sink receptacles 22 are shown and briefly described. The sink 22S1 has vertical side walls 310, a vertical front wall 312, a curved intermediate wall 314, and deck portions 316. The sink 22S2 has vertical front and rear walls 320 and 322, an S-shaped intermediate wall 324, and deck portions 326, this intermediate wall is similar to the intermediate wall 48 except the junctures at the lateral deck portions are rolled with greater radii and are not as angular.

Figure 17:
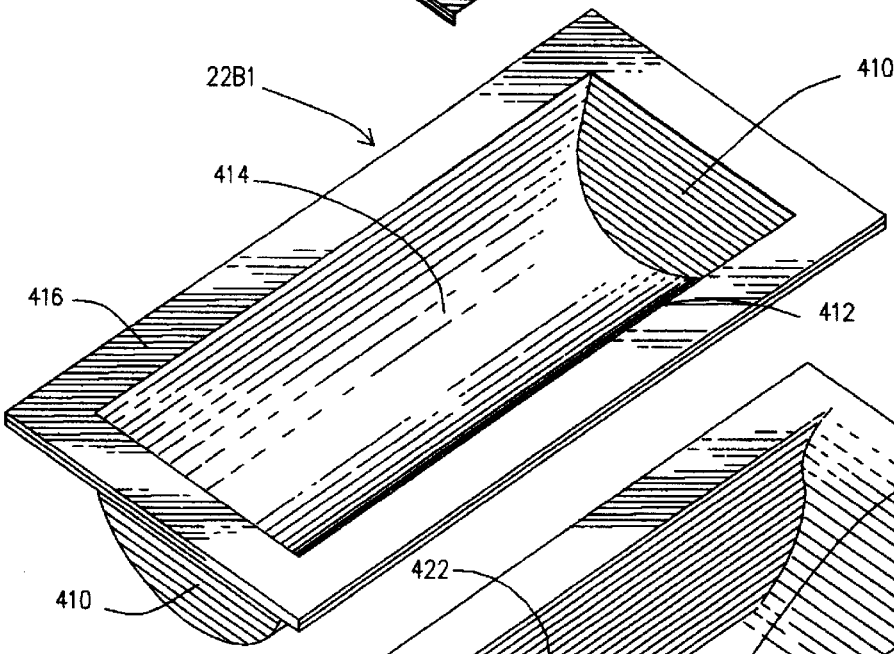
FIGS. 17 and 18 are isometric views of alternate embodiments of a bathtub constructed in accordance with the present invention.
Figure 18:
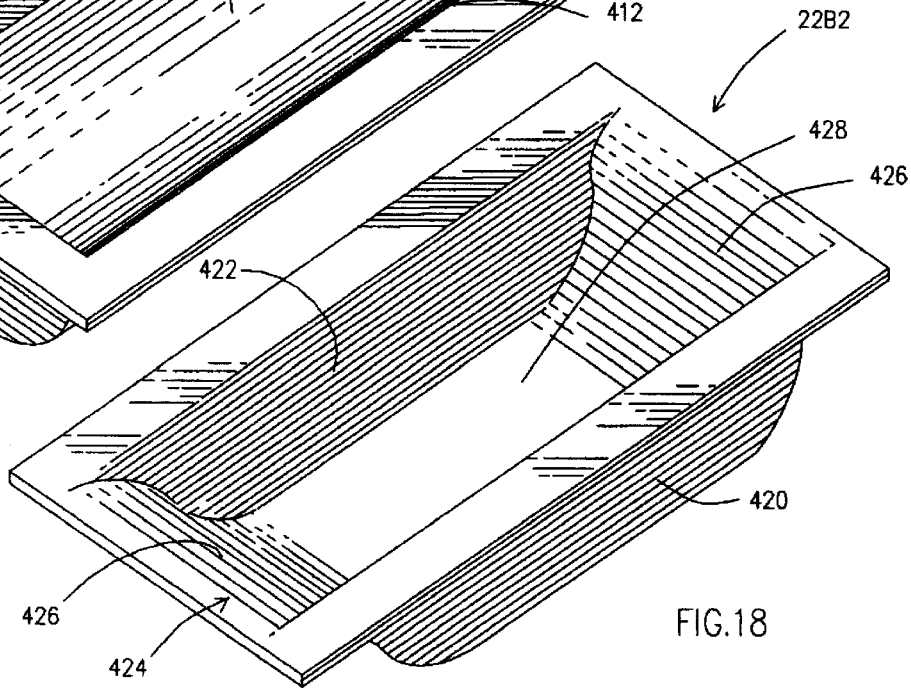

In FIGS. 17 and 18, alternative embodiments of the tub receptacles 22B are shown and briefly described. The tub 22B1 has end walls 410, a continuously curved intermediate wall 414, and deck portions 416. One of these end walls is inclined so that it serves as a backrest, while the other is vertical and includes the overflow and outlet. The tub 22B2 has vertical front and rear walls 420 and 422 like the tub 22B, and an intermediate wall 424 similar to the tub 22B except that the curves are S-shaped and smoother as shown and less angular.

OPERATION

From the foregoing description, it will be understood how the sink 22S or tub 22B, or the alternative embodiments, the water supply unit 26 and the water drainage unit 30 are all connected, that is, preplumbed, prior to their delivery to the jobsite. Installation is then very easily and quickly accomplished by attaching the receptacle 22 to the building wall 270, the inlet hoses 184 to the valves 180 and 182, and the drain pipe 226 to the main drain line 228.

As thus installed, it will be understood, particularly by reference to FIGS. 1 and 3, how the outlet 112 and the overflow 114 are obscured from all vantage points in front of the washing facility 20 except from a vantage point nearly directly over the facility so that one can look straight down into the sink 22S. The inlet 110 is very visible but hardly noticeable because of its flush relation to the rear wall 34. Moreover, the intermediate wall 48 of the sink 22S is imperforate, and only the inlet 110 and the low profile valve handles 200 and 202 are evidence of any plumbing. Although not visible, the stopper 24 is normally in its upper position where it is held by the restraining tabs 232. It is also noted that because of the shallow depth or height 96 of the sink 22S, the distance between the bottom portion 56 of the sink 22S and the floor of the building is high enough to allow accessibility to the sink by the handicapped.

To use the washing facility 20 (FIG. 1) the valve handles 200 and 202 are slid forwardly or rearwardly to adjust the water flow and thereby cause water to be ejected from the inlet 110. Water under pressure enters the mixing chamber 138 under high velocity where it is mixed to the desired temperature and settles and is then forced at a lower velocity through the nozzle 150 and out of the inlet in a smooth, arcing laminar, cascading sheet. This shaped flow, as illustrated in FIGS. 1 and 2, projects out over the bottom 56 of the sink 22S, for example, towards the outlet 112 so that the water stream is more available for washing both hands and face than if it were to descend straight down from a spigot in a cylindrical stream. The water stream also performs a natural cleaning function as it is ejected forwardly onto the sloped bottom portion of the intermediate wall 48, and its shape and arc present a pleasing aesthetic effect that is compatible with the shapes of the intermediate walls 48 and the handles 200, 202, 260. By sliding the valve handles back and forth, the water projection is increased and decreased.

A significant feature is that, with the minor exception of the handle 260, there are no projections or obstructions within the area of the sink 22S. Thus, the user can freely move his or her head, arms, or other limbs into and out of the sink without contact with such obstructions. Moreover, the curved end portions 58 complement the natural motion of one's hands and arms in the washing of hands and face, the cascading stream of water between these curved portions also facilitates the washing action.

If desired, the stopper 240 can be moved into its closed position to place the gate 248 over the outlet 112 in order to retain water in the sink 22S. In this position, the overflow 114 is exposed in the disclosed embodiment to allow water to escape if inadvertently allowed to continue to flow from the inlet 110. Moreover, the stopper is easy to remove and reinsert for cleaning and replacement. Although inherently dependable, the subject drainage unit has no complex linkages to break down and require repair.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A washing facility comprising:

a water receptacle having an upper rim, a bottom, and opposed front and rear walls extending down from the rim to the bottom, said walls having inner surfaces facing into the receptacle, the front wall having a receptacle outlet extending therethrough adjacent to the bottom thereof, the rear wall having a receptacle inlet extending therethrough adjacent to the rim, said inlet having an inner edge facing into the receptacle, the bottom having a slope that declines from the rear wall to the outlet and that lies in a first vertical plane passing through the inlet and the outlet, means including the front wall for obscuring the outlet from the view of a person positioned in front of the front wall looking along a line of sight extending down to the receptacle from a point above the receptacle immediately adjacent to but in front of a second vertical plane containing the rim of the front wall;

means for forcing water through the inlet past and in contact with the inner edge so that the water ejects from the inlet into the receptacle in a smooth, laminar stream that arcs forwardly and downwardly along the first vertical plane in spaced relation to the rear wall, that strikes said slope and flushes the same toward the outlet, and that is in the view of such a person positioned in front of the front wall and having said line of sight, wherein the front and rear walls are planar and substantially vertical, wherein the receptacle has an intermediate wall including the bottom and extending downwardly and inwardly from the rim to the bottom, and wherein the intermediate wall is joined to the front and rear walls, wherein the receptacle is a sink, and wherein the intermediate wall including the bottom has a continuously smooth curvature radially spaced from a substantially horizontal axis above the receptacle.

2. A washing facility comprising:

a water receptacle having an upper rim, a bottom, and opposed front and rear walls extending down from the rim to the bottom, the front wall having a receptacle outlet extending therethrough adjacent to the bottom thereof, means including the front wall for obscuring the outlet from the view of a person positioned in front of the front wall looking along a line of sight extending down to the receptacle from a point above the receptacle immediately adjacent to but in front of a first vertical plane containing the rim of the front wall, the rear wall having a receptacle inlet adjacent to the rim and visible to such a person looking along said line of sight, the bottom sloping to a low point adjacent to the outlet, means for supplying water to the inlet so that the water ejects from the inlet into the receptacle in a visible arcing stream that extends over the sloping bottom along a second vertical plane, and means for draining water from the outlet, wherein there is a deck having substantially horizontal surface portions extending outwardly from the rim, wherein the water supply means is mounted under the deck, wherein handle means is slidably mounted on the deck, wherein means interconnect the handle means and the water supply means to control the flow of water out of the inlet, wherein the inlet and the outlet lie generally along said second vertical plane, and wherein said handle means is movable lengthwise of said second plane.

3. The washing facility of claim 2, wherein the receptacle has inner and outer surfaces, wherein the inlet and outlet are flush with the inner surface, wherein there is a stopper for the outlet, wherein there are means mounting the stopper outside of the receptacle for movement between a position closing the outlet and a position opening the outlet, wherein there is a handle on the stopper extending into the receptacle, and wherein except for the stopper handle, the washing facility has no structural element which extends into or over the receptacle.

4. A washing facility comprising:

a washing receptacle having an upper rim, a substantially vertical planar front wall extending downwardly from the rim, said front wall having an inner surface facing into the receptacle and a lower edge, and a bottom portion that meets the front wall along the lower edge thereof, the front wall having an outlet formed in the lower edge of the front wall and adjacent to said bottom portion so that the periphery of the outlet is defined by the front wall and the bottom portion, the front wall also having an overflow adjacent to said upper rim, said bottom portion sloping downwardly toward the outlet, means for supplying water to the receptacle, a one-piece stopper having a lower gate and an elongated main body extending upwardly from the gate, an upper handle extending transversely from said body, and means mounting the stopper on the front wall with the body and the gate outside of the receptacle and the handle projecting into the receptacle adjacent to the inner surface of the front wall for up and down movement between a closed position with the gate closing the outlet and the handle exposing the overflow and an open position with the gate exposing the outlet and the handle covering the overflow.

5. A washing facility comprising:

longitudinally extending first, second and third walls having inner wall surfaces defining a washing receptacle therebetween, the first and second walls being planar and upstanding in transversely spaced relation to each other, each of the first and second walls having an upper edge, the third wall having a pair of side edges respectively joining the first and second walls and also having a pair of upper edges from which the third wall curves continuously downwardly to a center thereof;

a deck joining the upper edges of the first, second and third walls and providing horizontal top deck surfaces extending outwardly therefrom, the first wall having a substantially horizontal slot therethrough relatively adjacent to its upper edge and constituting a fluid inlet into the receptacle, the second wall having an upper overflow and a lower outlet therethrough respectively adjacent to its upper edge and to the side edge of the third wall near said center;

a stopper;

means mounting the stopper outside of the receptacle for movement between positions alternately covering the overflow and closing the outlet;

handle means projecting outwardly from one of said wall surfaces for operating the stopper;

valve means outside the receptacle and under the deck for controlling the supply of washing fluid to the inlet;

valve handles above the level of the deck;

means interconnecting the valve handles and the valve means for operating the same; and conduit means outside the receptacle and under the deck for removing washing fluid from the outlet and the overflow, the deck surface and the inner wall surfaces of the first and third walls being smooth and unobstructed except for said handles and handle means.

6. A washing facility that is adapted to be pre-plumbed prior to installation at the job site comprising:

a deck having top and bottom surfaces and extending outwardly from a rim around a washing area, the deck having openings extending therethrough from the top surface to the bottom surface;

a water receptacle having opposed planar walls and an arcuate central wall and inner and outer surfaces, said walls being joined to the rim of the deck in pendent relation thereto, one of the walls having an upper inlet adjacent to the rim and another of the walls having a lower outlet below the inlet and an upper overflow above the outlet, each of the inlet, outlet and overflow extending through its wall of the receptacle from the inner surface to the outer surface and being aligned with each other along a common vertical plane;

a water supply unit attached to the outer surface of the receptacle over the inlet and under the openings including hot and cold water valves connected to the inlet and water supply conduits connected to the valves;

a water drainage unit attached to the outer surface of the receptacle having a chamber over the overflow and the outlet, a drain conduit connected to the chamber, and a stopper slidably movable between a first position exposing the overflow and covering the outlet and a second position covering the overflow and exposing the outlet;

a pair of valve handles slidably movable in side-by-side relation on the deck over the openings;

means extending through the openings individually interconnecting the handles and the valves for opening and closing the valves in response to movement of the valve handles; and a stopper handle located adjacent to the inner surface of the receptacle and attached to the stopper for movement relative to the receptacle while moving the stopper between its first and second positions.

7. The washing facility of claim 6, wherein the planar walls are front and rear walls, wherein the inlet is in the rear wall and the outlet and overflow are in the front wall, and wherein all of the handles have top arcuate surfaces with similar geometric curvatures.

8. In a washing receptacle having inner and outer surfaces, an upper rim, a bottom, and an upstanding planar wall having upper and lower edges respectively joining the rim and the bottom, said wall having an upper overflow and a lower outlet;

a drainage housing attached to the outer surface of the wall and providing a drain chamber in fluid communication with the overflow an outlet, and means for connecting the chamber to a drain pipe;

a one-piece stopper located in the chamber having upper and lower ends and having a length greater than the distance between the overflow and the outlet, a lower end moveable into and out of an overlapping relation with the outlet, an intermediate portion, and an upper end;

a handle attached to the upper end in overlapping relation with the inner surface of the wall; and means mounting the stopper in the chamber with the handle extended into the receptacle and for movement of the lower end into and out of an overlapping and sealing relation with the outer surface of the wall over the outlet and for movement of the handle into and out of a covering and concealing relation to the overflow in response to up and down movement of the handle, said lower end being in its overlapping relation when the handle is out of its concealing relation and vice versa.

9. The washing receptacle of claim 8, wherein the body of the stopper is plastic and has an intermediate arcuate portion between the upper and lower ends and is moveable through the overflow to insert the stopper into and to remove the stopper from the chamber, and wherein the mounting means releasably mounts the stopper in said chamber so that the stopper can be withdrawn from the chamber through the overflow.

10. A washing facility comprising:

first, second and third walls having inner wall surfaces defining a washing receptacle therebetween, the first and second walls being planar and upstanding in opposed spaced relation to each other, each of the first and second walls having an upper edge, the third wall having a pair of side edges respectively joining the first and second walls and also having a pair of upper edges from which the third wall curves smoothly and continuously downwardly to a center thereof;

a deck joining the upper edges of the first, second and third walls and providing horizontal top deck surfaces extending outwardly therefrom, the first wall having a substantially horizontal slot therethrough relatively adjacent to its upper edge and constituting a fluid inlet into the receptacle, the second wall having a lower outlet therethrough adjacent to the side edge of the third wall near said center;

valve means outside the receptacle and under the deck for controlling the supply of washing fluid to the inlet;

valve handle means above the level of the deck;

means interconnecting the valve handle means and the valve means for operating the same; and conduit means outside the receptacle and under the deck for removing washing fluid from the outlet, the deck surface and the inner wall surfaces of the first and third walls being smooth and unobstructed except for said handle means.

11. The washing facility of claim 10, wherein the third wall is concave.

12. The washing facility of claim 10, wherein the third wall has upper convex portions radially spaced from horizontal axes below the receptacle and blending into a concave portion that is radially spaced from a substantially horizontal axis above the receptacle.

13. The washing facility of claim 10, wherein the walls meet without forming compound curves.

14. The washing facility of claim 10, wherein the outlet is obscured from the view of a person positioned adjacent to the second wall looking along a line of sight extending down to the receptacle from a point above the receptacle immediately adjacent to a vertical plane containing the upper edge of the second wall but on the side of said plane opposite the outlet.

15. The washing facility of claim 10, wherein the receptacle is made by a process selected from the group consisting of casting; stamping; and cutting, bending and bonding.

16. The washing facility of claim 10, wherein the receptacle is made from a material selected from the group consisting of metals, plastics, and composites.

17. A washing facility comprising:

a plurality of walls having upper edge portions and inner wall surfaces, the inner wall surfaces defining a washing receptacle therebetween, the walls including first and second planar walls upstanding in spaced relation to each other and a third wall having a pair of side edges respectively joining the first and second walls, said third wall having a pair of upper edges from which the third wall curves smoothly and continuously downwardly to a center thereof;

a deck extending from the upper edges of the first, second and third walls and providing horizontal top deck surfaces, means for supplying water to the receptacle from one of the first and second walls, the other one of the first and second walls having a lower outlet therethrough adjacent to said center;

valve means outside the receptacle and under the deck for controlling the supply of water to the receptacle;

handle means positioned over at least one of said surfaces;

means interconnecting the handle means and the valve means for operating the valve means; and conduit means outside the receptacle and under the deck for removing fluid from the outlet, the deck surfaces and the inner wall surfaces of the third wall and one of the first and second walls being smooth and unobstructed except for the handle means.

* * * * *